US009345305B2

(12) United States Patent
Sajuns

(10) Patent No.: US 9,345,305 B2
(45) Date of Patent: May 24, 2016

(54) APPARATUS AND METHODS FOR PROVIDING SAMPLES EXTERNAL TO THE PACKAGING OF A PRODUCT

(75) Inventor: Karola Sajuns, Frisco, TX (US)

(73) Assignee: MARY KAY INC., Addison, TX (US)

( * ) Notice: Subject to any disclaimer, the term of this patent is extended or adjusted under 35 U.S.C. 154(b) by 0 days.

(21) Appl. No.: 13/491,170

(22) Filed: Jun. 7, 2012

(65) Prior Publication Data

US 2013/0001119 A1 Jan. 3, 2013

Related U.S. Application Data

(60) Provisional application No. 61/494,286, filed on Jun. 7, 2011.

(51) Int. Cl.

| | |
|---|---|
| ***A45D 40/00*** | (2006.01) |
| ***A45D 40/24*** | (2006.01) |
| ***B65B 61/20*** | (2006.01) |

(52) U.S. Cl.

CPC ..... *A45D 40/00* (2013.01); *A45D 40/0087* (2013.01); *A45D 40/24* (2013.01); *B65B 61/202* (2013.01); *B65D 2221/00* (2013.01)

(58) Field of Classification Search

CPC ..... B65B 61/18; B65B 61/20; B65B 61/202; B65B 61/207; A45D 40/00; A45D 40/0087; A45D 40/24; A45D 2040/0006

USPC ..... 206/223, 385, 581, 730, 731, 779, 823; 220/23.87, 23.91

See application file for complete search history.

(56) References Cited

U.S. PATENT DOCUMENTS

| | | | | |
|---|---|---|---|---|
| 1,103,880 | A * | 7/1914 | Johnson | 206/730 |
| 3,241,738 | A * | 3/1966 | Freiman | 229/120.011 |
| 5,318,787 | A | 6/1994 | Brauner et al. | 426/120 |
| 5,566,830 | A | 10/1996 | Margolin | 206/730 |
| 5,842,324 | A | 12/1998 | Grasskopf et al. | 53/397 |
| 6,006,916 | A | 12/1999 | Matsos et al. | 206/581 |
| 6,190,730 | B1 | 2/2001 | Matsos et al. | 427/212 |
| 6,213,303 | B1 | 4/2001 | Harris et al. | 206/581 |
| 6,290,125 | B1 | 9/2001 | Breda | 229/120.07 |
| 7,070,055 | B2 * | 7/2006 | Lechanoine et al. | 206/581 |
| 7,316,310 | B2 | 1/2008 | Saschin | 206/232 |
| 8,910,784 | B2 * | 12/2014 | Moore | B65D 5/38 206/273 |
| 2003/0010350 | A1 | 1/2003 | De Laforcade | 132/294 |
| 2003/0066766 | A1 | 4/2003 | Lechanoine et al. | 206/216 |
| 2004/0011678 | A1 | 1/2004 | Ramet | 206/216 |

(Continued)

FOREIGN PATENT DOCUMENTS

| | | |
|---|---|---|
| EP | 1623395 | 10/2006 |
| KR | 3033609 | 11/1996 |

(Continued)

OTHER PUBLICATIONS

International Search Report and Written Opinion issued in PCT Application No. PCT/US2012/041278, dated Jan. 30, 2013.

(Continued)

*Primary Examiner* — Steven A. Reynolds
*Assistant Examiner* — Javier A Pagan
(74) *Attorney, Agent, or Firm* — Norton Rose Fulbright US LLP

(57) ABSTRACT

Apparatus and methods for providing samples (e.g., cosmetic samples) with primary product packages (e.g., cosmetic product packages) exterior to the primary product package.

8 Claims, 6 Drawing Sheets

(56) References Cited

U.S. PATENT DOCUMENTS

| | | | | |
|---|---|---|---|---|
| 2004/0055257 | A1 | 3/2004 | Parrotta et al. | 53/456 |
| 2004/0124102 | A1 | 7/2004 | Chalmers | 206/216 |
| 2006/0021901 | A1 | 2/2006 | Dobler et al. | 206/581 |
| 2007/0045154 | A1 | 3/2007 | Gelardi et al. | 206/736 |
| 2008/0041755 | A1 | 2/2008 | Noschang et al. | 206/494 |
| 2009/0032424 | A1* | 2/2009 | McLaughlin | 206/385 |
| 2012/0024726 | A1* | 2/2012 | Evert | 206/232 |

FOREIGN PATENT DOCUMENTS

| | | |
|---|---|---|
| KR | 20-0152163 Y1 | 7/1999 |
| WO | WO 99/02421 | 1/1999 |

OTHER PUBLICATIONS

International Preliminary Report on Patentability issued in PCT Application No. PCT/US2012/041278, dated Dec. 27, 2013.
Office Action issued in Korean Application No. 10-2014-7000373, dated May 7, 2014.
Korean Office Action issued in Korean Application No. 10-2014-7000373, dated Aug. 28, 2014.
Chinese Office Action issued in Application No. 201280034633.3, dated Aug. 28, 2014.
Chinese Office Action issued in Application No. 201280034633.3, dated Mar. 2, 2015. (English translation provided).
Supplemental European Search Report issued in European Application No. 12796708 on Apr. 15, 2014.

* cited by examiner

APPARATUS AND METHODS FOR PROVIDING SAMPLES EXTERNAL TO THE PACKAGING OF A PRODUCT

CROSS-REFERENCE TO RELATED APPLICATIONS

This application claims priority to U.S. Provisional Patent Application No. 61/494,286, filed Jun. 7, 2011, which is incorporated by reference in its entirety.

BACKGROUND

1. Field of the Invention

The present invention relates generally to providing product samples. More particularly, but not by way of limitation, the present invention relates to providing product samples external to the packaging of a product.

2. Background Information

Cosmetics have been packaged and sold to consumers. Cosmetic samples have also been packaged and provided to consumers. Non-limiting examples of cosmetics include blush, eyeliner, lipstick, lip gloss, mascara, cream, and/or lotion.

SUMMARY

The present disclosure includes embodiments of methods and apparatuses relating to providing product samples external to the primary packaging of a primary product.

Some embodiments of the present apparatuses comprise: a product container; a product package disposed around at least a portion of the product container; a sample package having a body with a sidewall defining a first end, a second end, a closed perimeter, an internal surface, and an external surface; and a cosmetic sample coupled to the body; where the body is configured to be disposed over the product package such that the product package extends through the first end of the body, the internal surface of the body faces toward the product package, and the external surface faces away from the product package. In some embodiments, the product container comprises a tube or bottle. In some embodiments, lip gloss or lipstick is disposed in the product container. In some embodiments, the cosmetic sample comprises lip gloss or lipstick.

Some embodiments of the present apparatuses further comprise: a reservoir coupled to the body; where the cosmetic sample is disposed in the reservoir. In some embodiments, the reservoir comprises plastic. In some embodiments, the plastic is transparent. In some embodiments, the reservoir comprises a metallic foil. In some embodiments, the body includes a first portion and a second portion that overlaps the first portion, and at least a portion of the reservoir is disposed between the first portion and the second portion. In some embodiments, the first portion includes an opening, the reservoir is included in a blister pack having a peripheral portion that extends laterally from the reservoir and is larger than the opening, and at least a portion of the reservoir is visible through the opening. In some embodiments, the product package has a length, and the sample package has a length extending between the first end and the second end that is between 50% and 100% of the length of the product package. In some embodiments, the body comprises paper and/or plastic. In some embodiments, the sample package is disposed over the product package. In some embodiments, the product package has a rectangular cross-sectional shape, and the sample package has a rectangular cross-sectional shape.

Some embodiments of the present methods comprise: coupling a cosmetic sample to a sheet of material having a first side and second side, a first end portion and a second end portion; and configuring the sheet of material such that the first end portion is couplable to the second end portion to form a body having a sidewall defining a first end, a second end, a closed perimeter, an internal surface, and an external surface, the body configured to slide over a product package such that the product package extends through the first end of the body, the internal surface of the body faces toward the product package, and the external surface faces away from the product package; where if the first end portion is coupled to the second end portion to form the body, the material forms the sidewall, and the first side of the sheet of material forms the exterior surface of the body (e.g., and/or the second side of the sheet of material forms the interior surface of the body).

In some embodiments of the present methods, coupling a cosmetic sample comprises coupling a reservoir to the sheet of material and disposing the cosmetic sample in the reservoir. In some embodiments, the sheet of material comprises an opening, the cosmetic sample is disposed in the reservoir of a package, and coupling the cosmetic sample to the sheet of material comprises aligning at least a portion of the reservoir with the opening and coupling a backer (e.g., that is unitary with the sheet of material) to the sheet of material such that at least a portion of the package is disposed between the sheet of material and the backer. In some embodiments, configuring comprises coupling an adhesive to at least one of the first end portion and the second end portion of the sheet of material. Some embodiments further comprise: covering the adhesive with a removable film. Some embodiments further comprise: disposing in a single container a plurality of configured sheets of material each including a removable film covering the adhesive, and each not having the first end portion coupled to the second end portion. In some embodiments, configuring comprises creasing the sheet of material at a plurality of locations between the first end portion and the second end portion. In some embodiments, the plurality of creases are configured such that the sheet of material can be folded along the creases, and the first end portion coupled to the second end portion, such that the body has a parallelogram-shaped cross-section. Some embodiments further comprise: coupling the first end portion to the second end portion such that the sheet of material forms the body. Some embodiments further comprise: coupling the body to a product package such that the product package extends through the first end and the second end of the body. In some embodiments, a primary cosmetic is disposed in the product package, and the cosmetic sample is different than the primary cosmetic.

Some embodiments of the present apparatuses comprise: a body having a sidewall defining a first end, a second end, a closed perimeter, an internal surface and an external surface; and a cosmetic sample coupled to the external surface of the body; where the body is configured to slide over a product package such that the product package extends through the first end of the body, the internal surface of the body faces toward the product package, and the external surface faces away from the product package.

In some embodiments, the body is configured to slide over the product package such that the product package extends through the first and second ends of the body. In some embodiments, the body is configured such that if the product package extends through the first end of the body, at least a portion of the internal surface of the body contacts the product package. Some embodiments further comprise: a reservoir coupled to the body; where the cosmetic sample is disposed in the reservoir. In some embodiments, the reservoir is unitary with the body. In some embodiments, the reservoir comprises plastic. In some embodiments, the reservoir includes a rim encircling the cosmetic sample. Some embodiments further comprise: a film coupled to the rim such that the film covers the cosmetic sample. In some embodiments, the film is transparent. In some embodiments, the reservoir comprises an envelope coupled to the exterior surface of the body. In some embodiments, the body is configured to slide over two or more product packages such that the two or more product packages extend through the first end of the body, the internal surface of the body faces toward the two or more product packages, and the external surface faces away from the two or more product packages. Some embodiments further comprise a second cosmetic sample coupled to the body. In some embodiments, the body comprises paper and/or plastic. In some embodiments, the apparatus is in combination with a product package extending through the first end of the body. In some embodiments, the product package extends through the second end of the body. In some embodiments, the product package contains a primary cosmetic. In some embodiments, the primary cosmetic is different than the cosmetic sample. In some embodiments, the cosmetic sample comprises blush, eyeliner, lipstick, lip color, lip gloss, mascara, cream, and/or lotion.

In any embodiment of the present disclosure, the term "substantially" may be substituted with "within [a percentage] of" what is specified, where the percentage includes 5, 10, and/or 15 percent.

Any embodiment of any of the present systems and/or methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Details associated with the embodiments described above and others are presented below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DESCRIPTION OF ILLUSTRATIVE EMBODIMENTS

The term "coupled" is defined as connected, although not necessarily directly, and not necessarily mechanically; two items that are "coupled" may be integral with each other. The terms "a" and "an" are defined as one or more unless this disclosure explicitly requires otherwise. The terms "substantially," "approximately," and "about" are defined as largely but not necessarily wholly what is specified, as understood by a person of ordinary skill in the art.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method that "comprises," "has," "includes" or "contains" one or more steps possesses those one or more steps, but is not limited to possessing only those one or more steps. Likewise, an apparatus that "comprises," "has," "includes" or "contains" one or more elements possesses those one or more elements, but is not limited to possessing only those one or more elements. For example, an apparatus that comprises a body and a cosmetic sample may also comprise a reservoir.

Further, a device or structure that is configured in a certain way is configured in at least that way, but it can also be configured in other ways than those specifically described.

Figure 1:
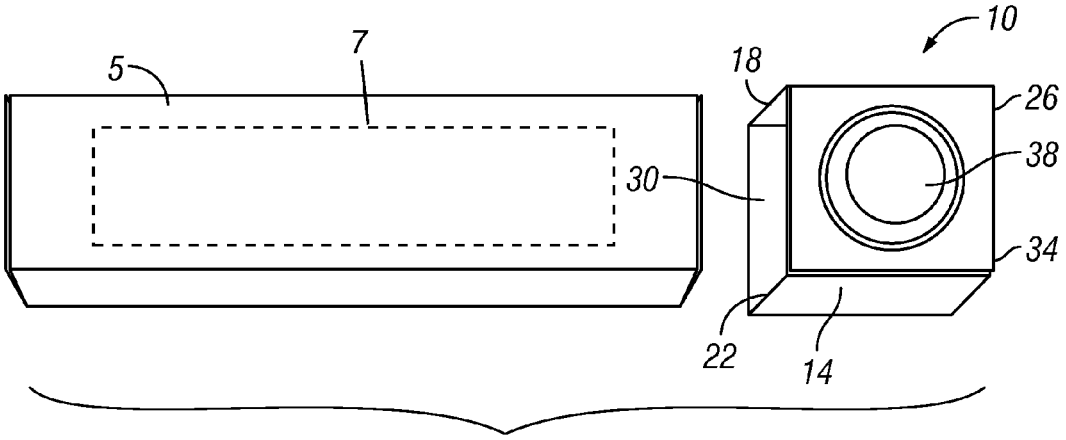
FIG. 1 depicts a perspective view of an embodiment of the present apparatuses, shown with a cosmetic product package with which the apparatus is configured to function.
Figure 2:
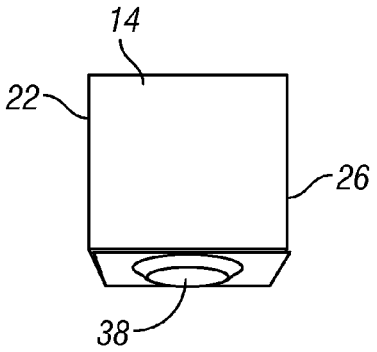
FIG. 2 depicts a side view of the apparatus of FIG. 1.
Figure 3:
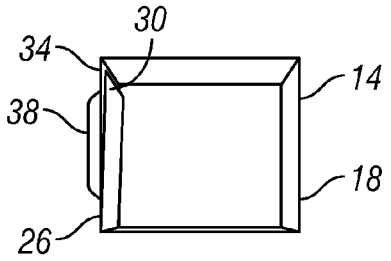
FIG. 3 depicts an end view of the apparatus of FIG. 1.
Figure 4:
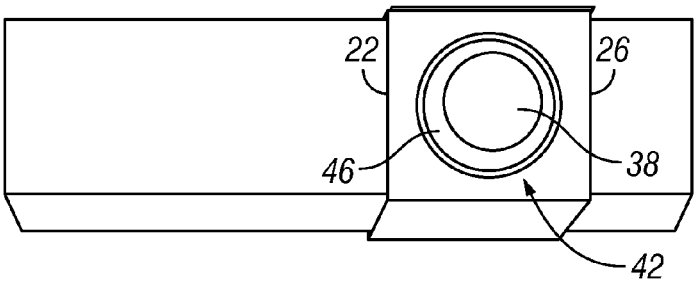
FIG. 4 depicts a perspective view of the apparatus of FIG. 1 shown disposed on the product package of FIG. 1.
Figure 5:
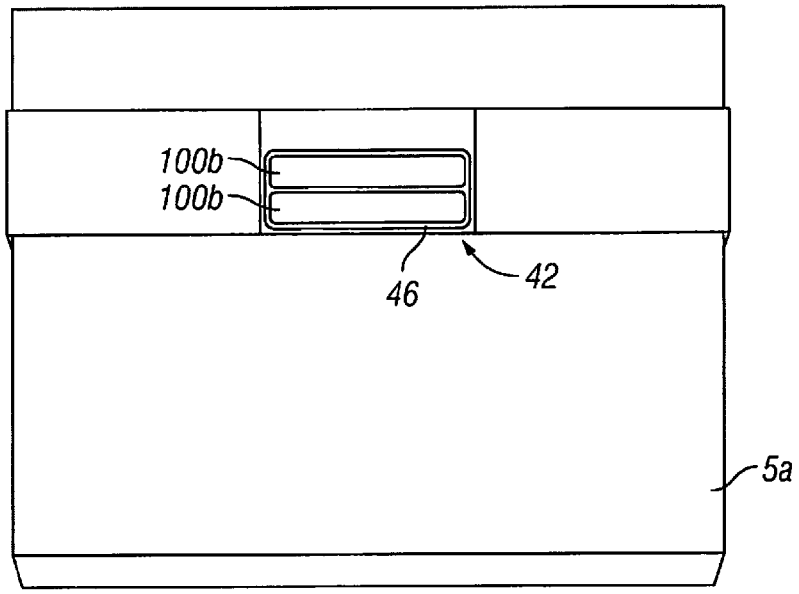
FIG. 5 depicts shows an alternate embodiment of the present apparatuses, configured to include multiple samples.
Figure 6A:
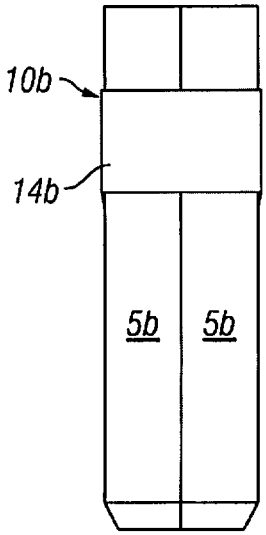
FIGS. 6A-6D depict additional alternate embodiments of the present apparatuses, configured to include different types of sample containers.
Figure 6B:
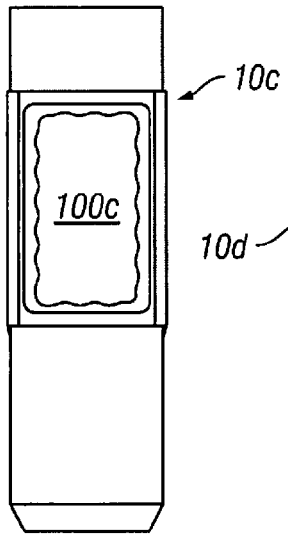
Figure 6C:
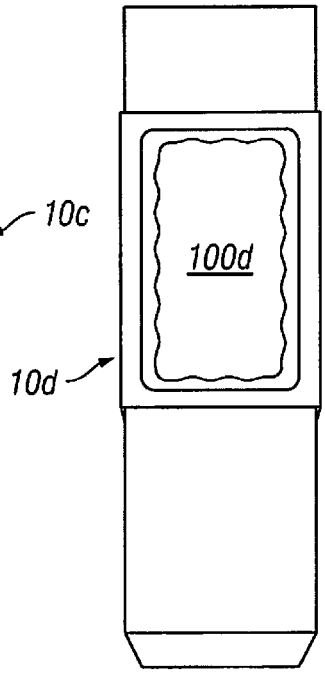
Figure 6D:
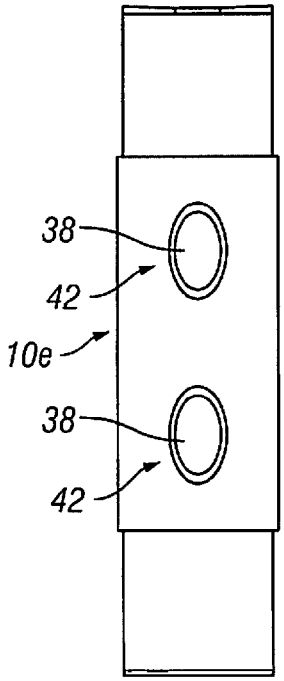

Referring now to the drawings, and more particularly to FIGS. 1-4, shown therein and designated by the reference numeral 10 is an embodiment of the present apparatuses, shown in FIGS. 1 and 4 with a cosmetic product package 5 (e.g., containing a product container 7) with which apparatus 10 is configured to function. In the embodiment shown, apparatus 10 comprises a body 14 having a sidewall 18 defining a first end 22, and a second end 26. Body 14 can comprise, for example, paper, cardboard, plastic, and/or any other material that permits apparatus to function as described in this disclosure. In the embodiment shown, apparatus 10 has a closed perimeter (e.g., sidewall 18 forms a closed loop between first end 22 and second end 26 (though sidewall 18 need not be entirely continuous, and may include perforations, openings, or the like). As shown, apparatus 10 includes an internal surface 30 and an external surface 34. Apparatus 10 also comprises a sample (e.g., a cosmetic sample) 38 coupled to external surface 34 of body 14.

In the embodiment shown, body 14 is configured to slide over product package 5 such that the product package extends through first end 22 of body 14, internal surface 30 faces toward the product package, and external surface 34 faces away from the product package. In the embodiment shown, body 14 is also configured to slide over the product package such that the product package extends through both of first end 22 and second end 26 of the body. For example, in the embodiment shown, first end 22 and second end 26 are both open (e.g., sidewall 18 does not reduce the size of the respective openings in first end 22 and second 26. In some embodiments, sidewall 18 (or another sidewall) may reduce the size of the respective openings in first end 22 and/or second end 26. In other embodiments, second end 26 may be closed or otherwise configured such that product package does not extend through second 26. In the embodiment shown, body 14 is configured such that if the product package extends through first end 22, at least a portion of internal surface 30 contacts the product package (e.g., contacts an exterior surface or portion of the product package).

In some embodiments, apparatus 10 comprises a reservoir 42 coupled to body 14, and cosmetic sample 38 is disposed in the reservoir. For example, in the embodiment shown, reservoir 42 includes a rim 46 encircling the cosmetic sample (e.g., rim 46 forms a bowl-shaped portion in which the cosmetic sample can be disposed). In some embodiments, reservoir 42 comprises plastic and/or may be coupled to body 14 by adhesive or the like. In some embodiments, reservoir 42 is unitary with body 14 (e.g., body 14 and reservoir 42 may comprise a unitary piece of plastic, body 14 and reservoir 42 may comprise a unitary piece of paper, or the like). For example, reservoir 42 may comprise a plastic blister that is built into (e.g., has a flange extending into) body 14, a powder disposed directly on the exterior surface of the body, or a rub-and-release sample coupled to the body. In some embodiments, apparatus 10 further comprises a film (not shown, but e.g., a transparent and/or plastic film) coupled to rim 46 such that the film covers the cosmetic sample.

Body 14 can comprise one or more of various materials, such as, for example, plastic or polymer, paper or other plant-pulp products, composites, and/or any other suitable material that enables the apparatus to function as described in this disclosure. In some embodiments, body 14 is resilient and/or elastic (e.g., may comprise rubber, latex, or the like) such that body 14 can be coupled to product packages having a variety of sizes. In some embodiments, product package 5 contains a primary cosmetic. Such a primary cosmetic may be different than the cosmetic of the cosmetic sample (e.g., may be a different color of the same type of cosmetic, may be a different type of cosmetic, may be a color of a different type of cosmetic that is intended or stated on product package 5 and/or apparatus 10 to coordinate with the color of the primary cosmetic, and/or the like). Such a primary cosmetic may also be the same as the cosmetic sample (e.g., to allow a consumer to see the primary cosmetic without opening the product package). Examples of types of primary cosmetics and/or cosmetic samples that may be used with or included in embodiments of the present apparatuses and product packages include: blush, eyeliner, lipstick, lip color, lip gloss, mascara, cream, and/or lotion. Product package 5 may be any suitable package, such as, for example, a box, a lipstick or lip gloss tube, a compact, a bottle, or the like, and may directly or indirectly contain the cosmetic. In some embodiments, the product package does not contain a cosmetic when an embodiment of the present apparatus is slid over or otherwise coupled to the product package.

Referring now to FIGS. 5 and 6A-6D, alternate embodiments of the present apparatuses are shown. Apparatus 10*a* is similar to apparatus 10, with the primary exception that apparatus 10*a* includes a second cosmetic sample 38*a* (and reservoir 42 includes a rim 46*a* that defines two compartments 100*b*, one for each produce sample). Additionally, apparatus 10*a* is configured to be coupled to a product package 5*a* with a size and shape that differs from that of package 5.

Apparatus 10*b* is similar to apparatus 10, with the primary exception that body 14*b* is configured to slide over two or more product packages 5*b* such that the two or more product packages extend through the first end of the body, the internal surface of the body faces toward the two or more product packages, and the external surface faces away from the two or more product packages.

Apparatuses 10*c* and 10*d* are each similar to apparatus 10, with the primary exception that their respective reservoirs 42*c* and 42*d* each comprise an envelope 100*c* and 100*d*, respectively, coupled to the exterior surface of the body.

Apparatus 10*e* is similar to apparatus 1, with the primary exception that it includes two reservoirs 42 that may contain dissimilar samples 38 (e.g., different products and/or different colors).

Referring now to FIGS. 7A-7D, an embodiment of the present apparatuses is shown in various stages of one of the present methods of making embodiments of the present apparatuses. In the embodiment shown, the method comprises: coupling a cosmetic sample 38 to (e.g., a first side 200 of) a sheet of material 204 also having a second side 208 (hidden in the figures, but opposite first side 200), a first end portion 212 and a second end portion 216. The sheets of material described in this disclosure can comprise, for example, paper, cardboard, plastic, and/or any other material that permits apparatus to function as described in this disclosure. In the embodiment shown, the method also comprises: configuring the sheet of material such that first end portion 212 is couplable to second end portion 216 to form a body (14) having a sidewall (18) defining a first end (22), a second end (26), a closed perimeter, an internal surface (30) and an external surface (34), the body configured to slide over a product package (5) such that the product package extends through the first end of the body, the internal surface of the body faces toward the product package, and the external surface faces away from the product package (e.g., as shown in FIG. 4). In the embodiment shown, if first end portion 212 is coupled to second end portion 216 to form the body, material 204 forms the sidewall (18), first side 200 forms the exterior surface (34) of the body, and second side 216 forms the interior surface (30) of the body.

Figure 7A:
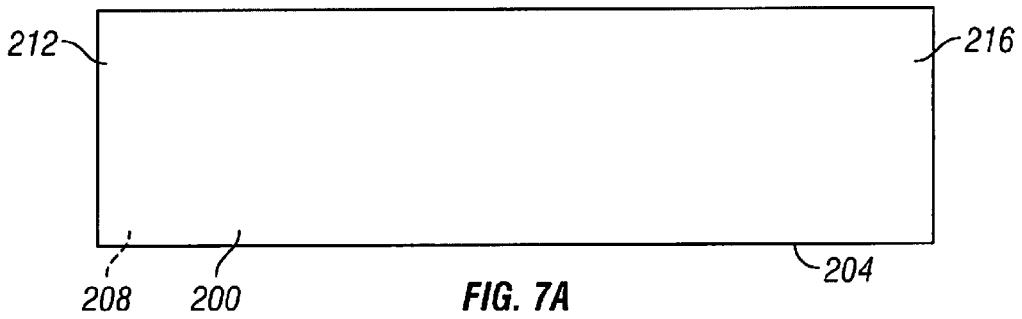
FIGS. 7A-7D depict embodiments of the present apparatuses in various stages of one of the present methods of making embodiments of the present apparatuses.
Figure 7B:
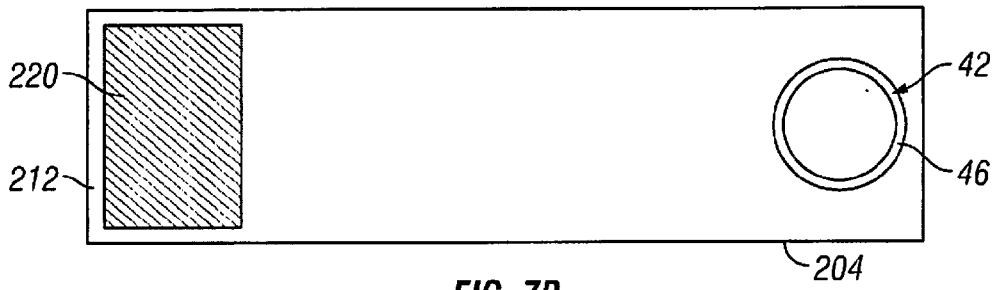
Figure 7C:
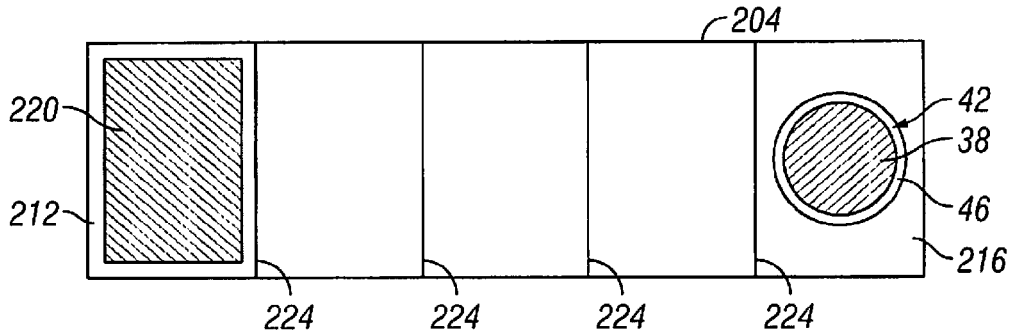

In the embodiment shown, coupling a cosmetic sample comprises coupling a reservoir 42 (e.g., having a rim 46) to sheet of material 204 (FIG. 7B) and disposing cosmetic sample 38 in the reservoir (FIG. 7C). In the embodiment shown, configuring the sheet of material such that first end portion 212 is couplable to second end portion 216 to form the body comprises coupling an adhesive 220 to at least one of the first end portion and the second end portion of the sheet of material (e.g., first end 212, as shown). Some embodiments comprise covering adhesive 220 with a removable film (not shown) such that, for example, material 204 can be shipped prior to coupling first end portion 212 to second end portion 216 without adhesive 220 sticking to other items. Some embodiments comprise: disposing in a single container a plurality of configured sheets of material each including a removable film covering the adhesive, and each not having the first end portion coupled to the second end portion (e.g., to be shipped prior to coupling first end portion 212 to second end portion 216).

Figure 7D:
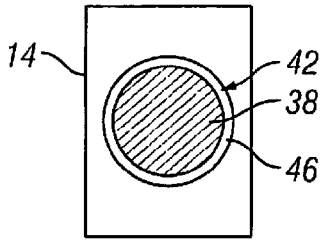
Figure 8:
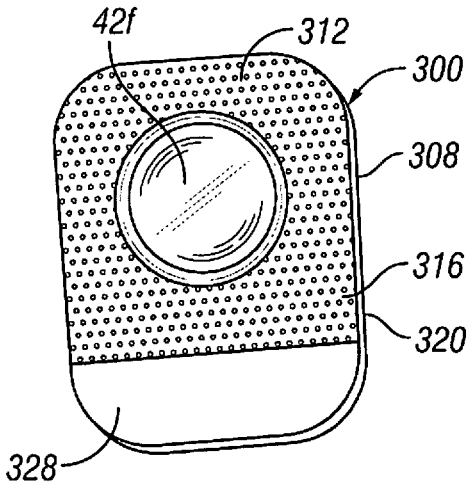
FIG. 8 depicts a perspective view of a blister pack for holding a cosmetic sample in some embodiments of the present apparatuses.

In some embodiments, configuring the sheet of material comprises creasing the sheet of material at a plurality of locations between the first end portion and the second end portion (e.g., to impart creases or fold-lines 224, as shown in FIG. 7C). For example, in the embodiment shown, creases 224 are configured such that sheet of material 204 can be folded along the creases, and first end portion 212 coupled to second end portion 216 (FIG. 7D), such that body 14 has a parallelogram-shaped cross-section (as shown in FIG. 3). Some embodiments of the present methods comprise: coupling first end portion 212 to second end portion 216 such that sheet of material 204 forms body 14 (FIG. 7D). Some embodiments comprise coupling body 14 to a product package (e.g., 5) such that the product package extends through the first end (22) and the second end (26) of the body (FIG. 4). In some embodiments of the present methods, a primary cosmetic is disposed in the product package, and the cosmetic sample is different than the primary cosmetic.

Referring now to FIGS. 8 and 9A-9E, FIG. 8 depicts a blister pack 300 holding a cosmetic sample 38, and FIGS. 9A-9E depict another embodiment 10*f* of the present apparatuses in various stages of one of the present methods of making the present apparatuses. In other embodiments, any suitable package (e.g., other than a blister pack) may be used, such as, for example, a bag, envelope, capsule, or the like. In some embodiments, the method can comprises: providing a sheet of material 204*f* having a first side 200*f*, a second side 208*f* opposite the first side, a first end portion 212*f*, a second end portion 216*f*, and an opening 228 extending through the sheet of material from the first side to the second side.

In some embodiments, the method can also comprise blister pack 300. In the embodiment shown, blister pack 300 includes a reservoir 42*f* and an outer perimeter 308 that extends laterally outwardly from at least a portion of (e.g., all of) the perimeter of reservoir 42*f* (e.g., blister pack has an extended peripheral region 312 having a larger area than reservoir 42*f*). For example, in the embodiment shown, blister pack 300 includes a top layer 316 and a bottom layer 320 that are bonded together in a peripheral region 312 to define reservoir 42*f* in an internal portion of blister pack 300. In some embodiment, top layer 316 can comprise a transparent material such as a plastic, and/or bottom layer 320 can comprise a metallic foil. Blister pack 300 can be configured to be opened by a user (e.g., without cutting the blister pack) to access the cosmetic sample in reservoir 42*f*. For example, in the embodiment shown, a tab portion 328 of top layer 316 is not bonded to bottom layer 320 such that top layer 316 can be pulled to separate top layer 316 from bottom layer 320.

In the embodiment shown, opening 228 in sheet of material 204*f* is larger than reservoir 42*f* (e.g., opening 228 can have a shape (e.g., circle) that is similar to the shape (e.g., circle) of reservoir 42*f*, as shown) but smaller than outer perimeter 308 and peripheral portion 312 such that reservoir 42*f* can extend through opening 228 without blister pack 300 being permitted to pass through opening 228 (e.g., peripheral portion 312 is too large to pass through opening 228). In the embodiment shown, sheet of material 204*a* includes a primary portion 232 that is configured such that first end portion 212*f* is couplable to second end portion 216*f* to form a body (14*f*) having a sidewall (18*f*) defining a first end (22*f*), a second end (26*f*), a closed perimeter, an internal surface (30*f*) and an external surface (34*f*), the body configured to slide over a product package (5*f*) such that the product package extends through the first end of the body, the internal surface of the body faces toward the product package, and the external surface faces away from the product package (e.g., as shown in FIG. 9E). In the embodiment shown, if first end portion 212*f* is coupled to second end portion 216*f* (e.g., via adhesive 220*f*) to form the body, material 204*f* forms the sidewall (18*f*), first side 200*f* forms the exterior surface (34*f*) of the body, and second side 216*f* forms the interior surface (30) of the body.

In the embodiment shown, material 204*f* also comprises a backer portion 236 extending laterally from (e.g., and perpendicular to the length of) primary portion 232, as shown. In this embodiment, backer portion 236 is configured to be folded over, as shown in FIG. 9C, such that second side 208*f* of backer portion 236 contacts and/or is adhered (e.g., via adhesive 222*f*) to second side 208*f* of primary portion 232*f* to maintain reservoir 42*f* of blister pack 300 in opening 228. For example, in the embodiment shown, sheet of material 204*f* comprises a crease or fold line 224*f* extending between primary portion 232 and backer portion 236. In the embodiment shown, backer portion 236 also comprises slits 240 configured to align with corresponding creases 224*f* of primary portion 232 such that when back portion 236 is folded relative to primary portion 232, primary portion 232 can still be folded as shown in FIG. 9D (with backer portion 236 interior to primary portion 232). In the embodiment shown, slits 240 extend along a majority (e.g., 80% or more) of width 244 of backer portion, and width 244 of backer portion 236 is sufficient to cover opening 228 when backer portion 236 is folded relative to primary portion 232. For example, width 244 can be equal to or just smaller than width 248 of primary portion 232 (e.g., width 244 may be 90% of width 248 or more, as shown). Additionally, in the embodiment shown (FIG. 9A), ends 252 of backer portion 236 are spaced apart from the next-adjacent creases 224*f* of primary portion 232 such that when backer portion 236 is folded relative to primary portion 232 (FIG. 9C), back portion 236 does not interfere with folding of primary portion 232, and such that backer portion 236 remains parallel to outer portions (does not In some embodiments, configuring the sheet of material comprises creasing the sheet of material at a plurality of locations between the first end portion and the second end portion (e.g., to impart creases or fold-lines 224*f*) and/or between primary portion 232 and backer portion 236. For example, in the embodiment shown, creases 224*f* are configured such that sheet of material 204*f* can be folded along the creases, and first end portion 212 coupled to second end portion 216*f*, such that body 14*f* has a parallelogram-shaped cross-section (as shown in FIG. 9D). Some embodiments of the present methods comprise: coupling first end portion 212*f* to second end portion 216*f* such that sheet of material 204*f* forms body 14*f* (FIGS. 9D-9E). Some embodiments comprise coupling body 14 to a product package (e.g., 5*f*) such that the product package extends through the first end (22) and the second end (26) of the body (FIG. 4). For example, in the embodiment shown, primary portion 232 includes four creases 224*f*.

Figure 9A:
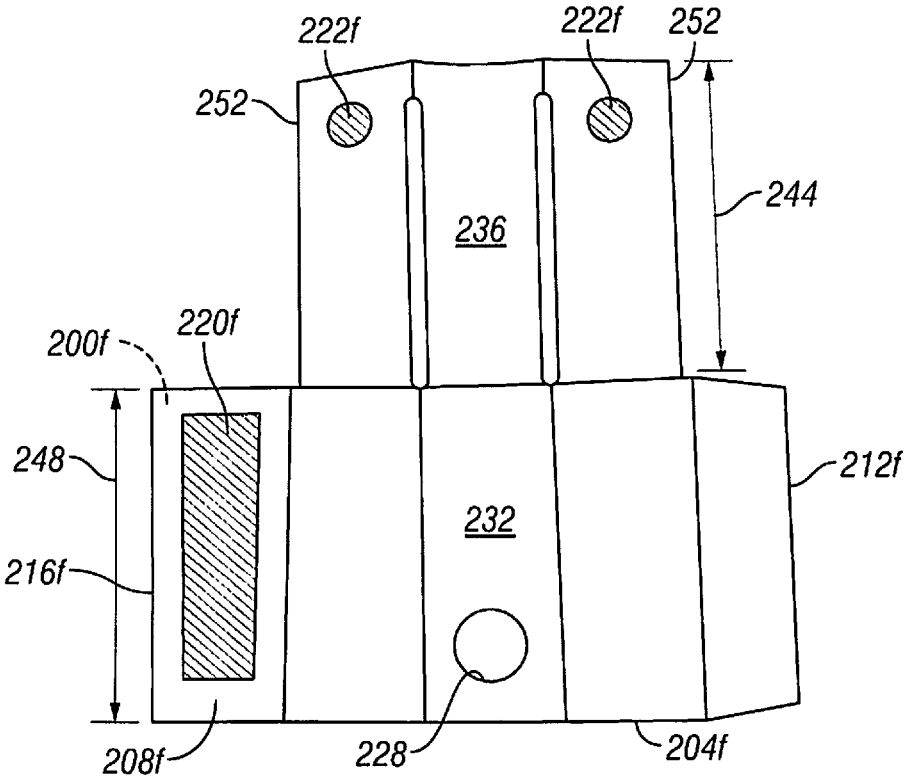
FIGS. 9A-9E depicts another embodiment of the present apparatuses in various stages of one of the present methods of making the present apparatuses.
Figure 9B:
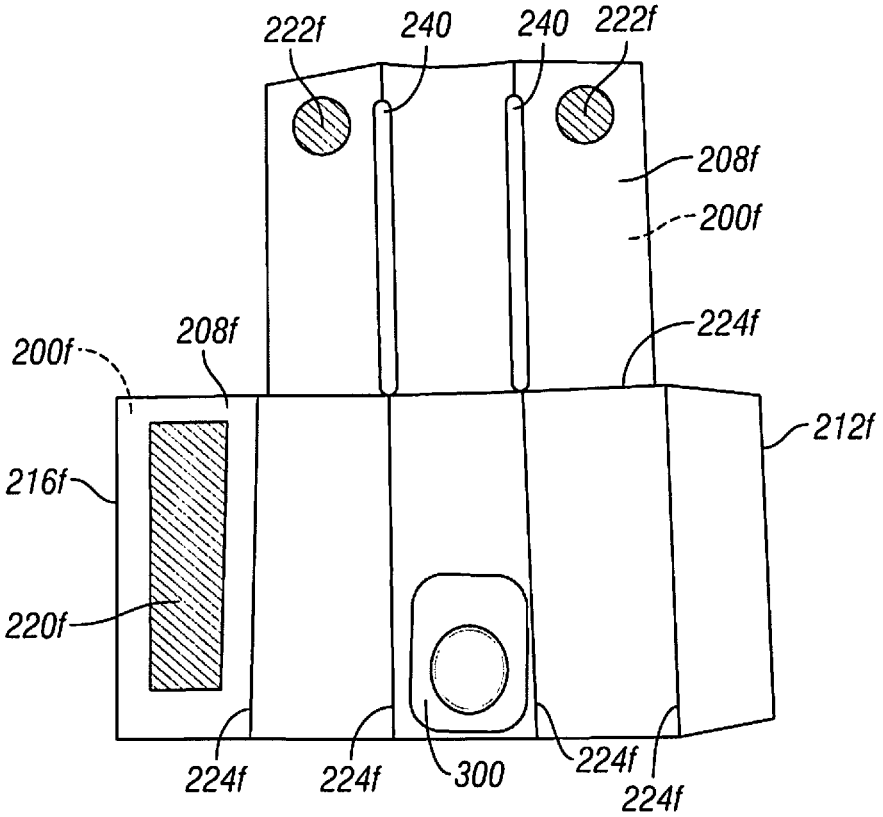
Figure 9C:
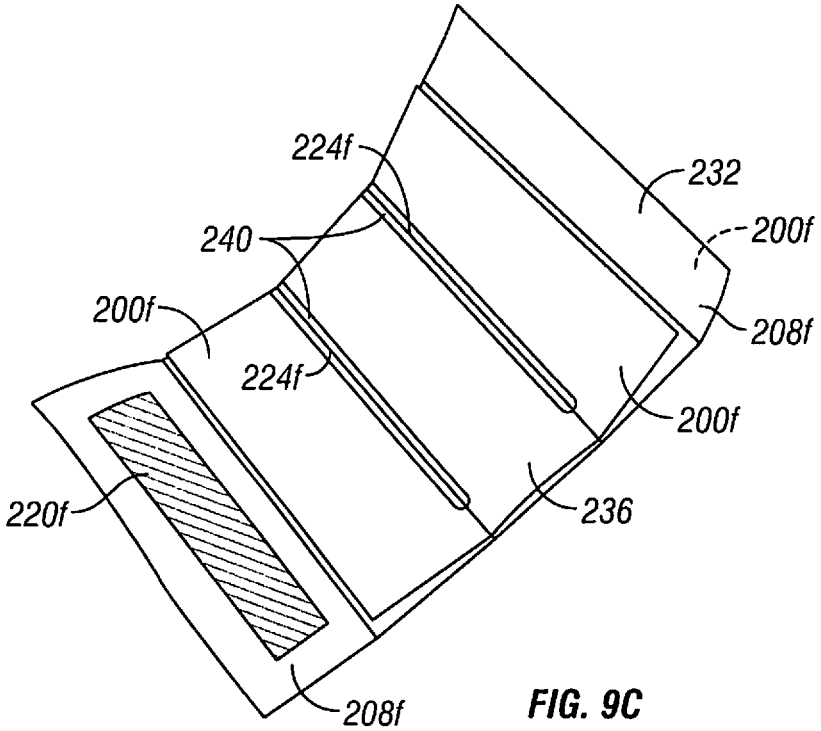
Figure 9D:
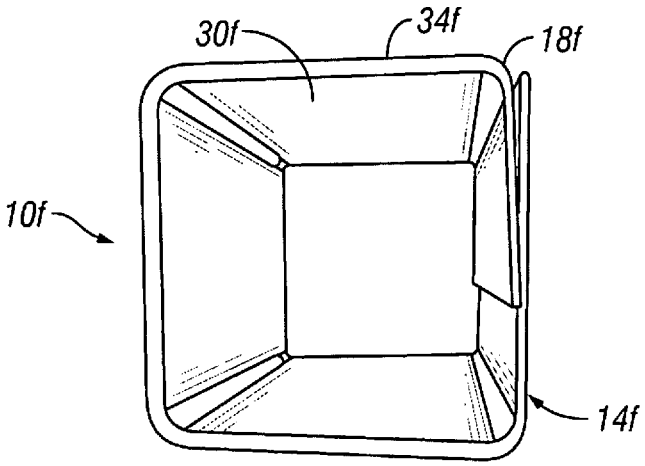
Figure 9E:
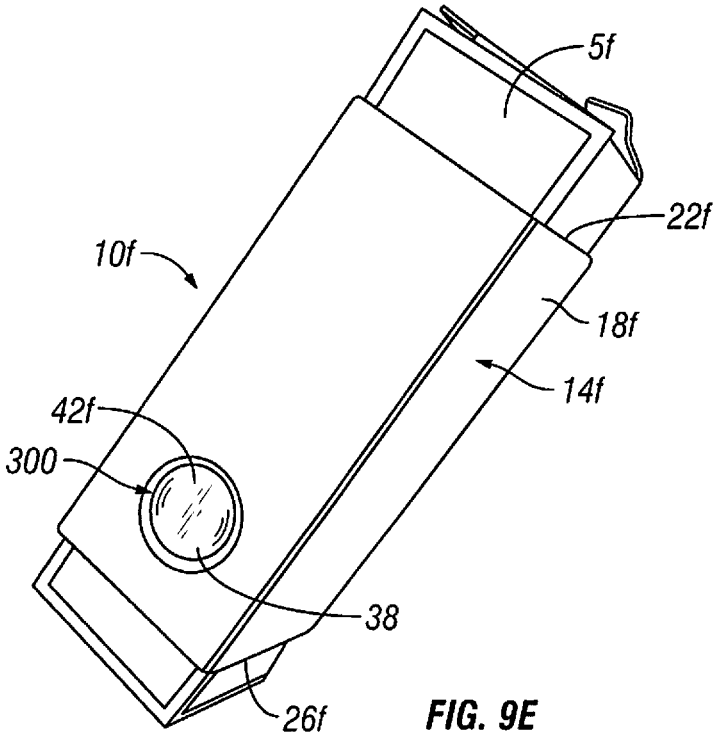

In the embodiment shown, coupling a cosmetic sample comprises disposing a blister pack 300 having a reservoir 42*f* (and a cosmetic sample disposed in the reservoir) relative to sheet of material 204 with top sheet 316 facing first side 200*a* such that reservoir 42 is aligned with and/or extends through opening 228, as shown in FIG. 9B; and folding backer portion 236 relative to (e.g., and adhering back portion 236 to) primary portion 232 to maintain the position of blister pack 300 relative to material 204*f*, as shown in FIG. 9C. In this embodiment, once blister pack 300 is coupled to material 204*f*, primary portion 232 is folded along creases 224*f* and first end portion 212*f* is coupled (e.g., as described above) to second end portion 216*f*, as shown in FIG. 9D, such that apparatus 10*f* can be disposed over a product package 5*f*, as shown in FIG. 9E.

The above specification and examples provide a complete description of the structure and use of exemplary embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the present apparatuses and methods are not intended to be limited to the particular forms disclosed. Rather, they include all modifications and alternatives falling within the scope of the claims, and embodiments other than the one shown may include some or all of the features of the depicted embodiment. For example, backer portion 236 can comprise a second sheet of material that is physically separate from primary portion prior to adhering or otherwise coupling backer portion 236 to primary portion 232. For example, components may be combined as a unitary structure, and/or connections may be substituted. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. An apparatus comprising:

a product container;

a product package disposed around at least a portion of the product container;

a sample package having a body with a sidewall defining a first end, a second end, a closed perimeter, an internal surface, and an external surface;

a cosmetic sample coupled to the body such that a portion of the body is disposed between the cosmetic sample and the product package; and a reservoir coupled to the body;

where the cosmetic sample is disposed in the reservoir, where the body is configured to be disposed over the product package such that the product package extends through the first end of the body, the internal surface of the body faces toward the product package, and the external surface faces away from the product package, and where the body includes a first portion and a second portion that overlaps the first portion, the first portion comprises a plurality of longitudinal folds that divide the first portion into a plurality of panels, and the second portion overlaps a plurality of the longitudinal panels; and where at least a portion of the reservoir is disposed between the first portion and the second portion, the first portion including an opening, and the reservoir comprising a peripheral portion that extends laterally from the reservoir and is larger than the opening.

2. The apparatus of claim 1, where lip gloss or lipstick is disposed in the product container.

3. The apparatus of claim 2, where the cosmetic sample comprises lip gloss or lipstick.

4. The apparatus of claim 1, where the reservoir comprises transparent plastic.

5. The apparatus of claim 1, where the reservoir comprises a metallic foil.

6. The apparatus of claim 1, where the reservoir is included in a blister pack and at least a portion of the reservoir is visible through the opening.

7. The apparatus of claim 1, where the sample package is disposed over the product package.

8. The apparatus of claim 1, where the body comprises a sheet of material that defines both of:

at least a portion of the outer surface; and the portion of the body that is disposed between the cosmetic sample and the product package.

* * * * *